US007655132B2

(12) United States Patent
Miller et al.

(10) Patent No.: US 7,655,132 B2
(45) Date of Patent: Feb. 2, 2010

(54) PROCESS FOR IMPROVING THE LUBRICATING PROPERTIES OF BASE OILS USING ISOMERIZED PETROLEUM PRODUCT

(75) Inventors: Stephen J. Miller, San Francisco, CA (US); John M. Rosenbaum, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 607 days.

(21) Appl. No.: 10/839,396

(22) Filed: May 4, 2004

(65) Prior Publication Data

US 2005/0247600 A1 Nov. 10, 2005

(51) Int. Cl.
*C10M 101/02* (2006.01)

(52) U.S. Cl. ..... 208/18; 208/19; 508/110; 585/13

(58) Field of Classification Search ..... 208/18, 208/19

See application file for complete search history.

(56) References Cited

U.S. PATENT DOCUMENTS 4,812,246 A 3/1989 Yabe
4,906,350 A 3/1990 Lucien et al.
5,321,172 A * 6/1994 Alexander et al. ..... 585/2
6,096,940 A 8/2000 Wittenbrink et al.
6,332,974 B1 12/2001 Wittenbrink et al.
7,141,157 B2 * 11/2006 Rosenbaum et al. ..... 208/18
7,144,497 B2 * 12/2006 Lok et al. ..... 208/18

OTHER PUBLICATIONS

John S. Manka and Kim L. Ziegler, "Factors affecting performance of crude oil wax-control additives", World Oil / Jun. 2001, pp. 75-81.

* cited by examiner

*Primary Examiner*—Ellen M McAvoy
(74) *Attorney, Agent, or Firm*—Crowell & Moring LLP

(57) ABSTRACT

A method for improving the lubricating properties of a isomerized distillate base oil having a kinematic viscosity at 100 degrees C. between about 2.5 cSt and about 8 cSt, the method comprising blending with said isomerized distillate base oil a sufficient amount of a pour point depressing base oil blending component to reduce the pour point of the resulting base oil blend at least 3 degrees C. below the pour point of the distillate base oil wherein the pour point depressing base oil blending component is an isomerized petroleum derived base oil containing material having a boiling range above about 1050 degrees F.; also lubricating base oil blends prepared according to the process; and the pour point depressing base oil blending component.

46 Claims, No Drawings

PROCESS FOR IMPROVING THE LUBRICATING PROPERTIES OF BASE OILS USING ISOMERIZED PETROLEUM PRODUCT

FIELD OF THE INVENTION

This invention is directed to a process for lowering the pour point and raising the VI of an isomerized distillate base oil by blending it with a pour point depressing base oil blending component prepared from an isomerized petroleum derived product. The invention is also directed to novel base oil blends.

BACKGROUND OF THE INVENTION

Finished lubricants used for automobiles, diesel engines, axles, transmissions, and industrial applications consist of two general components, a lubricating base oil and additives. Lubricating base oil is the major constituent in these finished lubricants and contributes significantly to the properties of the finished lubricant. In general, a few lubricating base oils are used to manufacture a wide variety of finished lubricants by varying the mixtures of individual lubricating base oils and individual additives.

Numerous governing organizations, including Original Equipment Manufacturers (OEM's), the American Petroleum Institute (API), Association des Consructeurs d' Automobiles (ACEA), the American Society of Testing and Materials (ASTM), and the Society of Automotive Engineers (SAE), among others, define the specifications for lubricating base oils and finished lubricants. Increasingly, the specifications for finished lubricants are calling for products with excellent low temperature properties, high oxidation stability, and low volatility. Currently, only a small fraction of the base oils manufactured today are able to meet these demanding specifications.

Lubricating base oils are base oils having a viscosity of about 3 cSt or greater at 100 degrees C., preferably about 4 cSt or greater at 100 degrees C.; a pour point of about 9 degrees C. or less, preferably about −15 degrees C. or less; and a VI (viscosity index) that is usually about 90 or greater, preferably about 100 or greater. In general, lubricating base oils should have a Noack volatility no greater than current conventional Group I or Group II light neutral oils. Group II base oils are defined as having a sulfur content of equal to or less than 300 ppm, saturates equal to 90 percent or greater, and a VI between 80 and 120. A Group II base oil having a VI between about 110 and 120 is referred to in this disclosure as a Group II plus base oil. Group III base oils are defined as having a sulfur content of equal to or less than 300 ppm, saturates equal to 90 percent or greater, and a VI of greater than 120. It would be advantageous to be able to boost the VI of a Group II base oil into the Group II plus and the VI of a Group II plus base oil into the Group III base oil range. The present invention makes it possible to lower pour point and raise VI.

Base oil refers to a hydrocarbon product having the above properties prior to the addition of additives. That is, the term "base oil" generally refers to a petroleum or syncrude fraction recovered from the fractionation operation. "Additives" are chemicals which are added to improve certain properties in the finished lubricant so that it meets relevant specifications. Conventional pour point additives are expensive and add to the cost of the finished lubricant. Some additives also present solubility problems and require their use along with a solvent.

Consequently, it is desirable to use the minimum amount of an additive necessary to produce an on-specification lubricant.

Pour point which is an important property of base oils intended for blending into finished lubricants is the lowest temperature at which movement of the base oil is observed. In order to meet the relevant pour point specification for a finished lubricant, it is often necessary to lower the pour point of the base oil by the addition of an additive. Conventional additives which have been used to lower the pour point of base oils are referred to as pour point depressants (PPDs) and typically are polymers with pendant hydrocarbon chains that interact with the paraffins in the base oil by inhibiting the formation of large wax crystal lattices. Examples of pour point depressants known to the art include ethylene-vinyl-acetate copolymers, vinyl-acetate olefin copolymers, alkyl-esters of styrene-maleic-anhydride copolymers, alkyl-esters of unsaturated-carboxylic acids, polyalkylacrylates, polyalklymethacrylates, alkyl phenols, and alpha-olefin copolymers. Many of the known pour point depressants are solid at ambient temperature and must be diluted drastically with solvent prior to use. See *Factors Affecting Performance of Crude Oil Wax-Control Additives* by J. S. Manka and K. L. Ziegler, World Oil, June 2001, pages 75-81. Pour point depressants taught in the literature have a wax-like paraffinic part, which co-crystallizes with the wax-forming components in the oil, and a polar part which hinders crystal growth. The pour point depressing base oil blending component employed in the present invention differs from pour point depressants known from the prior art in being essentially polar-free. One of the advantages of the present invention is that the pour point depressing base oil blending component of the present invention is not an additive in the conventional sense. The pour point depressing base oil blending component used in the invention is only a high boiling waxy petroleum fraction which has been isomerized. Therefore, it does not lend itself to problems which have been associated with the use of conventional additives.

The pour point depressing base oil blending component used in the present invention is generally prepared from a waxy petroleum bottoms fraction, preferably from a waxy bright stock, such as, for example, bright stock derived from a high paraffinic crude. Bright stock constitutes a bottoms fraction which has been highly refined and dewaxed. Bright stock is a high viscosity base oil which is named for the SUS viscosity at 210 degrees F. Typically petroleum derived bright stock will have a viscosity above 180 cSt at 40 degrees C., preferably above 250 cSt at 40 degrees C., and more preferably ranging from 500 to 1100 cSt at 40 degrees C. Bright stock derived from Daqing crude has been found to be satisfactory for carrying out the present invention.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" is intended as a transition meaning the exclusion of all but the recited elements with the exception of only minor traces of impurities.

SUMMARY OF THE INVENTION

The present invention is directed to a method for improving the lubricating properties of an isomerized distillate base oil having a kinematic viscosity at 100 degrees C. between about 2.5 cSt and about 8 cSt, the method comprising blending with said isomerized distillate base oil a sufficient amount of a pour point depressing base oil blending component to reduce the pour point of the resulting base oil blend at least 3 degrees C. below the pour point of the isomerized distillate base oil wherein the pour point depressing base oil blending component is an isomerized petroleum derived base oil containing material having a boiling range above about 1050 degrees F. (about 565 degrees C.). Preferably the pour point depressing base oil blending component will contain at least 40 weight percent of material boiling above 1050 degrees F. (about 565 degrees C.), more preferably it will contain at least 60 weight percent of material boiling above 1050 degrees F., and most preferably will contain at least 80 weight percent boiling above 1050 degrees F. Especially preferred is a pour point depressing base oil blending component in which 90 weight percent or more of the hydrocarbons present boil above about 1150 degrees F. (about 620 degrees C.). The average molecular weight of the pour point depressing base oil blending component usually will be at least 600 and preferably will be at least 700, and more preferably at least 800.

The pour point depressing base oil blending component is generally prepared from the bottoms fraction of a waxy petroleum crude, such as, for example, Daqing crude. Particularly preferred for preparing the pour point depressing base oil blending component is bright stock containing a high wax content. The pour point depressing base oil blending component may also be prepared from other waxy petroleum derived sources such as slack wax. Typically the wax is partially isomerized to a pour point between −20 degrees C. and about 20 degrees C., with a pour point from about −10 degrees C. to about 20 degrees C. being especially preferred. Hydroisomerization introduces branching into the paraffin molecules. Generally the molecules of the pour point depressing base oil blending component following isomerization will display an average degree of branching in the molecules of at least 5 branches per 100 carbon atoms. Preferably the degree of branching will be between about 6 and about 8 alkyl branches per 100 carbon atoms. The pour point depressing base oil blending component preferably will contain 30 weight percent or more paraffins, more preferably will contain 40 weight percent or more paraffins, and most preferably 50 weight percent or more paraffins. Solvent dewaxing may optionally be used to enhance the pour point depressing properties of the isomerized hydrocarbons of the invention. In general, the waxy fraction recovered from the solvent dewaxing operation will be more effective in lowering pour point than the oily fraction.

As used in this disclosure the term "alkyl branch" refers to a monovalent radical having the general formula $C_nH_{2n+1}$. Typically "n" in the alkyl branches present in the molecules of the pour point depressing base oil blending component of the invention will be the integer 1, 2, or 3, i.e., the alkyl will be methyl, ethyl, or propyl, although the invention is not intended to preclude the presence of some larger branches.

In addition to lowering pour point, the pour point depressing base oil blending component also has been found to raise the viscosity index (VI) of the lubricating base oil blend. Typically, the lubricating base oil blend will have a VI at least 3 numbers higher than the distillate base oil component. Preferably the lubricating base oil blend will have a VI of 110 or higher. The method of the invention makes it possible to upgrade Group II base oils to Group II plus base oils or to upgrade Group II plus base oils to Group III base oils.

The isomerized distillate base oil may be either a conventional petroleum-derived base oil or a synthetic base oil, such as a base oil recovered from a Fischer-Tropsch synthesis operation. It may be a light neutral base oil or a medium neutral base oil. Depending upon the amount of pour point depressing base oil blending component blended with the isomerized distillate base oil, the cloud point of the base oil blend may be raised. Therefore, if the cloud point of the base oil blend is a critical specification, the isomerized distillate base oil must have a cloud point no higher than the target cloud point. Preferably the cloud point of the isomerized distillate base oil will be lower than the target specification to allow for some rise in the cloud point and still meet the specification. Base oils intended for use in certain finished lubricants often require a cloud point of 0 degrees C. or less. Therefore, for base oils intended for those applications, a cloud point below 0 degrees C. is desirable.

Particularly surprising, it has been found that the degree of change for the values of both pour point and VI of the lubricating base oil blends could not have been predicted by only observing the properties of the individual components. In each case a premium was observed. That is to say, the pour point of the blend containing the isomerized distillate base oil and the pour point depressing base oil blending component is not merely a proportional averaging of the two pour points, but the value obtained is significantly lower than would be expected. For example, the pour point will always be lower than the value for either of the two individual components. This is true even when the pour point depressing blending component comprises 3.5 weight percent or less of the lubricating base oil blend. The same is also true for VI. The VI of the mixture is not the proportional average of the VI's for the two components but is generally higher than would be expected, and in many cases, the VI of the base oil blend will exceed the VI of either component.

Preferably, in the base oil blend, the pour point depressing base oil blending component will comprise no more than about 15 weight percent of the base oil blend, more preferably 7 weight percent or less, and most preferably 3.5 weight percent or less. Since it is usually desirable to maintain as low a cloud point as possible for the base oil blend, only the minimum amount of the pour point depressing base oil blending component necessary to meet the pour point and/or VI specifications is added to the isomerized distillate base oil. The pour point depressing base oil component will also increase the viscosity of the blend. Therefore the amount of the pour point depressing base oil component which can be added may also be limited by the upper viscosity limit.

The present invention is also directed to a lubricating base oil blend having a kinematic viscosity at 100 degrees C. above about 3 cSt and further containing a high boiling fraction having a boiling range above about 950 degrees C. and a low boiling fraction having a boiling range below about 950 degrees C., wherein when the high boiling fraction is distilled out the low boiling fraction has a higher pour point than the entire lubricating base oil blend. Generally, the high boiling fraction will usually contain at least 30 weight percent of paraffins. In addition, the kinematic viscosity of the blend at 100 degrees C. will be between about 3 cSt and about 8 cSt, preferably between about 4 cSt and about 7 cSt. If the base oil blend is intended for use as an engine oil the cloud point should be 0 degrees C. or less.

DETAILED DESCRIPTION OF THE INVENTION

Pour point refers to the temperature at which a sample of the isomerized distillate base oil or the pour point depressing base oil blending component will begin to flow under carefully controlled conditions. In this disclosure, where pour point is given, unless stated otherwise, it has been determined by standard analytical method ASTM D-5950 or its equivalent. Cloud point is a measurement complementary to the pour point, and is expressed as a temperature at which a sample begins to develop a haze under carefully specified conditions. Cloud points in this specification were determined by ASTM D-5773-95 or its equivalent. Kinematic viscosity described in this disclosure was measured by ASTM D-445 or its equivalent. VI may be determined by using ASTM D-2270-93 (1998) or its equivalent. As used herein, an equivalent analytical method to the standard reference method refers to any analytical method which gives substantially the same results as the standard method. Molecular weight may be determined by ASTM D-2502, ASTM D-2503, or other suitable method. For use in association with this invention, molecular weight is preferably determined by ASTM D-2503-02.

The branching properties of the pour point depressing base oil blending component of the present invention was determined by analyzing a sample of oil using carbon-13 NMR according to the following seven-step process. References cited in the description of the process provide details of the process steps. Steps 1 and 2 are performed only on the initial materials from a new process.

1) Identify the CH branch centers and the $CH_3$ branch termination points using the DEPT Pulse sequence (Doddrell, D. T.; D. T. Pegg; M. R. Bendall, *Journal of Magnetic Resonance* 1982, 48, 323ff.).
2) Verify the absence of carbons initiating multiple branches (quaternary carbons) using the APT pulse sequence (Patt, S. L.; J. N. Shoolery, *Journal of Magnetic Resonance* 1982, 46, 535ff.).
3) Assign the various branch carbon resonances to specific branch positions and lengths using tabulated and calculated values (Lindeman, L. P., *Journal of Qualitative Analytical Chemistry* 43, 1971 1245ff; Netzel, D. A., et. al., *Fuel,* 60, 1981, 307ff).

EXAMPLES

| Branch | NMR Chemical Shift (ppm) |
|---|---|
| 2-methyl | 22.5 |
| 3-methyl | 19.1 or 11.4 |
| 4-methyl | 14.0 |
| 4+methyl | 19.6 |
| Internal ethyl | 10.8 |
| Propyl | 14.4 |
| Adjacent methyls | 16.7 |

4) Quantify the relative frequency of branch occurrence at different carbon positions by comparing the integrated intensity of its terminal methyl carbon to the intensity of a single carbon (=total integral/number of carbons per molecule in the mixture). For the unique case of the 2-methyl branch, where both the terminal and the branch methyl occur at the same resonance position, the intensity was divided by two before doing the frequency of branch occurrence calculation. If the 4-methyl branch fraction is calculated and tabulated, its contribution to the 4+methyls must be subtracted to avoid double counting.
5) Calculate the average carbon number. The average carbon number may be determined with sufficient accuracy for lubricant materials by dividing the molecular weight of the sample by 14 (the formula weight of $CH_2$).
6) The number of branches per molecule is the sum of the branches found in step 4.
7) The number of alkyl branches per 100 carbon atoms is calculated from the number of branches per molecule (step 6) times 100/average carbon number.

Measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 second acquisition time. In order to minimize non-uniform intensity data, the proton decoupler was gated off during a 10 second delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH. And the methyls are clearly identified by chemical shift and phase. Both are described in the references cited. The branching properties of each sample were determined by C-13 NMR using the assumption in the calculations that the entire sample was iso-paraffinic. Corrections were not made for n-paraffins or naphthenes, which may have been present in the oil samples in varying amounts. The naphthenes content may be measured using Field Ionization Mass Spectroscopy (FIMS).

FIMS analysis was conducted by placing a small amount (about 0.1 mg.) of the base oil to be tested in a glass capillary tube. The capillary tube was placed at the tip of a solids probe for a mass spectrometer, and the probe was heated from about 50 degrees C. to 600 degrees C. at 100 degrees C. per minute in a mass spectrometer operating at about 10-6 torr. The mass spectromer used was a Micromass Time-of-Flight mass spectrometer. The emitter was a Carbotec 5 um emitter designed for FI operation. A constant flow of pentaflourochlorobenzene, used as lock mass, was delivered into the mass spectrometer via a thin capillary tube. Response factors for all compound types were assumed to be 1.0, such that weight percent was given directly from area percent.

Since petroleum derived hydrocarbons as well as synthetic hydrocarbons comprise a mixture of varying molecular weights having a wide boiling range, this disclosure will refer to the 10 percent point and the 90 percent point of the respective boiling ranges. The 10 percent point refers to that temperature at which 10 weight percent of the hydrocarbons present within that cut will vaporize at atmospheric pressure. Similarly, the 90 percent point refers to the temperature at which 90 weight percent of the hydrocarbons present will vaporize at atmospheric pressure. In this disclosure when referring to boiling range distribution, the boiling range between the 10 percent and 90 percent boiling points is what is being referred to. For samples having a boiling range above 1000 degrees F., the boiling range distributions in this disclosure were measured using the standard analytical method D-6352 or its equivalent. For samples having a boiling range below 1000 degrees F., the boiling range distributions in this disclosure were measured using the standard analytical method D-2887 or its equivalent. It will be noted that only the 10 percent point is used when referring to the pour point depressing base oil blending component, since it is generally derived from a bottoms fraction which makes the 90 percent point or upper boiling limit irrelevant.

The Pour Point Depressing Base Oil Blending Component

The pour point depressing base oil blending component, as already noted above, is not a conventional pour point depressing additive. Rather it is a high boiling waxy fraction of a petroleum-derived base oil which has been partially isomerized to a pour point of between about −20 degrees C. and about 20 degrees C., usually between about −10 degrees C. and about 20 degrees C. One skilled in the art will recognize that the greater the degree of conversion, the higher the yield loss. Therefore, in isomerizing the pour point depressing base oil blending component, low pour point must be balanced against higher yield.

The pour point depressing base oil blending component of the invention preferably will have a paraffin content of at least about 30 weight percent, more preferably at least 40 weight percent, and most preferably at least 50 weight percent. The boiling range of the pour point depressing base oil blending component should be above about 950 degrees F. (510 degrees C.). A boiling range greater than about 1050 degrees F. (565 degrees C.) is preferred with a boiling range in excess of 1150 degrees F. (620 degrees C.) being especially preferred.

It has been found that when the pour point depressing base oil blending component is used to reduce the pour point, the pour point of the lubricating base oil blend will be below the pour point of both the pour point depressing base oil blending component and the distillate base oil. Therefore, it is usually not necessary to reduce the pour point of the pour point depressing base oil blending component to the target pour point of the lubricating base oil blend. Accordingly, the actual degree of isomerization need not be as high as might otherwise be expected, and the isomerization reactor may be operated at a lower severity with less cracking and less yield loss. It has been found that the pour point depressing base oil blending component should not be over isomerized or its ability to act as a pour point depressing base oil blending component will be compromised. In general the average degree of branching in the molecules of the pour point depressing base oil blending component should be at least 5 alkyl-branches per 100 carbon atoms. Preferably, the number of branches will fall within the range of from about 6 to about 8 alkyl-branches per 100 carbon atoms.

It has also been found that by solvent dewaxing the isomerized material, the effectiveness of the pour point depressing base oil blending component may be enhanced. The waxy product separated during solvent dewaxing has been found to display improved pour point depressing properties. The oily product recovered after the solvent dewaxing operation while displaying some pour point depressing properties is less effective than the waxy product.

The pour point depressing base oil blending component is usually prepared from the bottoms fraction recovered from the bottom of the vacuum tower of a refining operation handling a waxy petroleum crude. As already noted above, the higher boiling bottom fractions generally will display the best pour point depressing activity with the cut boiling between about 1150 degrees F. (about 620 degrees C.) and about 1350 degrees F. (about 735 degrees C.) showing the greatest activity. Particularly preferred for preparing the pour point depressing base oil blending component is bright stock containing a high wax content. Bright stock derived from Daqing crude has been found to be especially suitable for use as the pour point depressing base oil blending component of the present invention.

The Isomerized Distillate Base Oil

The separation of synthetic or petroleum derived crudes into various fractions having characteristic boiling ranges is generally accomplished by either atmospheric or vacuum distillation or by a combination of atmospheric and vacuum distillation. As used in this disclosure, the term "distillate fraction" or "distillate" refers to a side stream product recovered either from an atmospheric fractionation column or from a vacuum column as opposed to the "bottoms" which represents the residual higher boiling fraction recovered from the bottom of the column. Atmospheric distillation is typically used to separate the lighter distillate fractions, such as naphtha and middle distillates, from a bottoms fraction having an initial boiling point above about 700 degrees F. to about 750 degrees F. (about 370 degrees C. to about 400 degrees C.). At higher temperatures thermal cracking of the hydrocarbons may take place leading to fouling of the equipment and to lower yields of the heavier cuts. Vacuum distillation is typically used to separate the higher boiling material, such as the distillate base oil fractions which are used in carrying out the present invention. Thus the distillate base oil and the bottoms product from which the pour point depressing base oil blending component is prepared are usually recovered from the vacuum distillation column, although the invention is not intended to be limited to any particular mode of separating the components.

The isomerized distillate base oil fraction used in carrying out the invention will have a kinematic viscosity at 100 degrees C. between about 2.5 cSt and about 8 cSt. Preferably, the viscosity will be between about 3 cSt and about 7 cSt at 100 degrees C. If the target cloud point for the lubricating base oil blend is 0 degrees C., the cloud point of the isomerized distillate base oil preferably should be 0 degrees C. or less. The distillate base oil may be either conventionally derived from the refining of petroleum or the refining of syncrude recovered from a Fischer-Tropsch synthesis reaction. The isomerized distillate base oil may be a light neutral base oil or a medium neutral base oil.

Typically the isomerized distillate base oil will have a boiling range having the 10 percent point falling between about 625 degrees F. and about 790 degrees F. The 90 percent point will usually fall between about 725 degrees F. and about 950 degrees F., preferably the 90 percent point will fall between about 725 degrees F. and about 900 degrees F.

The distillate base oil should be hydroisomerized prior to being blended with the pour depressing base oil blending component. Surprisingly solvent dewaxing the distillate base oil were unsuitable for use in blends of the present invention. Hydroisomerization which is also used in the preparation of the pour point depressing base oil blending component is explained in greater detail below.

The present invention is particularly advantageous when used with isomerized distillate base oils having a VI of less than 110, since such base oils are usually unsuitable for preparing high quality lubricants without the addition of significant amounts of VI improvers. Due to the VI premium which has been observed when using the pour point depressing base oil blending component of the invention, the VI of marginal base oils may be significantly improved without the use of conventional additives. The pour point depressing base oil blending component of the present invention by increasing the VI, makes it possible to upgrade Group II base oils having a VI of less than 110 up to Group II plus base oils. It is also possible by using the present invention to upgrade Group II plus base oils to Group III base oils.

Lubricating Base Oil Product

A lubricating base oil blend prepared according to the process of the present invention will have a kinematic viscosity greater than about 3 cSt at 100 degrees C. Usually the kinematic viscosity at 100 degrees C. will not exceed about 8 cSt. The lubricating base oil blend will also have a pour point below about −9 degrees C. and a VI that is usually greater than about 90. Preferably the kinematic viscosity at 100 degrees C. will be between about 3 cSt and about 7 cSt, the pour point will be about −15 degrees C. or less, and the VI will be about 100 or higher. Even more preferably the VI will be 110 or higher. The cloud point of the lubricating base oil preferably will be 0 degrees C. or below. The pour point of the lubricating base oil blend will be at least 3 degrees C. lower than the pour point of the lower viscosity component of the blend. Preferably, the pour point of the blend will be at least 6 degrees C. below the pour point of the isomerized distillate base oil and more preferably at least 9 degrees C. below the pour point of the distillate base oil. At the same time, the VI of the blend will preferably be raised by at least three numbers above the VI of the isomerized distillate base oil. The properties of the lubricating base oils prepared using the process of the invention are achieved by blending the isomerized distillate base oil with the minimum amount of the pour point depressing base oil blending component necessary to meet the desired specifications for the product.

In achieving the selected pour points, the pour point depressing base oil blending component usually will not comprise more than about 15 weight percent of the base oil blend. Preferably, it will comprise 7 weight percent or less, and most preferably the pour point depressing base oil blending component will comprise 3.5 weight percent or less of the blend. The minimum amount of the pour point depressing base oil blending component to meet the desired specifications for pour point and VI is usually preferred to avoid raising the cloud point and/or viscosity of the blend to an unacceptable level. At the lower levels of addition, the effect on cloud point is generally negligible.

As already noted, when the pour point depressing base oil blending component is blended with the isomerized distillate base oil, a VI premium is observed. The term "VI premium" refers to a VI boost in which the VI of the blend is significantly higher than would have been expected from a mere proportional averaging of the VI's for the two fractions. The improvement in VI resulting from the practice of the present invention makes it possible to produce a Group III base oil, i.e., a base oil having a VI greater than 120, from a Group II plus base oil, i.e., a base oil having a VI between 110 and 120. A Group II plus base oil may also be prepared from a Group II base oil having a VI below about 110.

A further advantage of the process of the present invention is that the volatility of the lubricating base oil blend may be lowered relative to that of the isomerized distillate base oil fraction. The pour point depressing base oil blending component is characterized by a very low Noack volatility. Consequently, depending upon how much of the pour point depressing base oil blending component is blended with the isomerized distillate base oil, the lubricating base oil blend may have a lower Noack volatility than the isomerized distillate base oil fraction alone.

Lubricating base oil blends prepared according to the process of the present invention display a distinctive boiling range profile. Therefore, the lubricating base oil blend comprising the isomerized distillate base oil and the pour point depressing base oil blending component may be described as a lubricating base oil blend having a kinematic viscosity at 100 degrees C. above about 3 cSt and further containing a high boiling fraction having a boiling range above about 950 degrees C. and a low boiling fraction having a boiling range below about 950 degrees C., wherein when the high boiling fraction is distilled out the low boiling fraction has a higher pour point than the entire lubricating base oil blend. Generally, the high boiling fraction will have a paraffin content of at least about 30 weight percent. The low boiling fraction corresponds to the isomerized distillate base oil, and the high boiling fraction corresponds to the pour point depressing base oil blending component.

Lubricating base oil blends of the invention may be identified by using simulated distillation to determine the 950 degrees F. weight percent point. For instance, if the blend is 85 weight percent below 950 degrees F., one would distill off, by conventional distillation methods well known to those skilled in the art, 85 weight percent of the blend to get a 950 degrees F. cutpoint.

Hydroisomerization

Hydroisomerization, or for the purposes of this disclosure simply "isomerization", is intended to improve the cold flow properties of the base oils used to prepare the pour point depressing base oil blending component and the distillate base oil by the selective addition of branching into the molecular structure. In the present invention, it is essential that the waxy bottoms or slack wax be isomerized at some point during its processing in order to make it suitable for use as a pour point depressing base oil blending component. Likewise the distillate base oil must be isomerized prior to being blended with the pour point depressing base oil blending component.

Isomerization ideally will achieve high conversion levels of the wax to non-waxy iso-paraffins while at the same time minimizing the conversion by cracking. Since wax conversion can be complete, or at least very high, this process typically does not need to be combined with additional dewaxing processes to produce a high boiling product with an acceptable pour point. In preparing the pour point depressing blending component of the present invention, generally, the wax is partially isomerized to a pour point between about −10 degrees C. and about 20 degrees C. Isomerization operations suitable for use with the present invention typically use a catalyst comprising an acidic component and may optionally contain an active metal component having hydrogenation activity. The acidic component of the catalyst preferably includes an intermediate pore SAPO, such as SAPO-11, SAPO-31, and SAPO-41, with SAPO-11 being particularly preferred. Intermediate pore zeolites, such as ZSM-22, ZSM-23, SSZ-32, ZSM-35, and ZSM-48, also may be used in carrying out the isomerization. Typical active metals include molybdenum, nickel, vanadium, cobalt, tungsten, zinc, platinum, and palladium. The metals platinum and palladium are especially preferred as the active metals, with platinum most commonly used.

The phrase "intermediate pore size", when used herein, refers to an effective pore aperture in the range of from about 4.0 to about 7.1 Angstrom (as measured along both the short or long axis) when the porous inorganic oxide is in the calcined form. Molecular sieves having pore apertures in this range tend to have unique molecular sieving characteristics. Unlike small pore zeolites such as erionite and chabazite, they will allow hydrocarbons having some branching into the molecular sieve void spaces. Unlike larger pore zeolites such as faujasites and mordenites, they are able to differentiate between n-alkanes and slightly branched alkenes, and larger alkanes having, for example, quaternary carbon atoms. See U.S. Pat. No. 5,413,695. The term "SAPO" refers to a silicoaluminophosphate molecular sieve such as described in U.S. Pat. Nos. 4,440,871 and 5,208,005.

In preparing those catalysts containing a non-zeolitic molecular sieve and having a hydrogenation component, it is usually preferred that the metal be deposited on the catalyst using a non-aqueous method. Non-zeolitic molecular sieves include tetrahedrally-coordinated [AlO2] and [PO2] oxide units which may optionally include silica. See U.S. Pat. No. 5,514,362. Catalysts containing non-zeolitic molecular sieves, particularly catalysts containing SAPO's, on which the metal has been deposited using a non-aqueous method have shown greater selectivity and activity than those catalysts which have used an aqueous method to deposit the active metal. The non-aqueous deposition of active metals on non-zeolitic molecular sieves is taught in U.S. Pat. No. 5,939,349. In general, the process involves dissolving a compound of the active metal in a non-aqueous, non-reactive solvent and depositing it on the molecular sieve by ion exchange or impregnation.

Solvent Dewaxing

In conventional refining, solvent dewaxing is used to remove small amounts of any remaining waxy molecules from the lubricating base oil after hydroisomerization. In the present invention, solvent dewaxing may optionally be used to enhance the pour point depressing properties of the isomerized wax. In this instance, the waxy fraction recovered from the solvent dewaxing step is generally more effective in lowering pour point than the oily fraction. Solvent dewaxing is done by dissolving the isomerized waxy bottoms or slack wax in a solvent, such as methyl ethyl ketone, methyl iso-butyl ketone, or toluene. See U.S. Pat. Nos. 4,477,333; 3,773,650; and 3,775,288.

It has been found that lubricating base oil blends prepared according to the process of the invention are compatible with conventional pour point depressants. Therefore, additives intended to further improve pour point may be added to the lubricating base oil blends of the invention to prepare finished lubricants. Generally pour point depressants will comprise between about 0.1 to about 1 weight percent of the finished lubricant.

The following examples are intended to illustrate the invention but are not to be construed as a limitation on the scope of the invention.

EXAMPLES

Example 1

Bright stock was prepared from Daqing crude by hydroisomerization for use as a pour point depressing base oil blending component. The properties of the Daqing bright stock were as follows:

| | |
|---|---|
| Kinematic viscosity at 100° C. | 21.5 cSt |
| Viscosity index (VI) | 138 |
| Pour point | −18° C. |
| Cloud point | 15° C. |

-continued

| Simulated Distillation, ° F./Wt. % | |
|---|---|
| ST/5 | 897/960 |
| 10/30 | 989/1055 |
| 50 | 1108 |
| 70/90 | 1167/1253 |
| 95/EP | 1291/1338 |

Example 2

Varying amounts of the bright stock described in Example 1 were blended with a isomerized petroleum-derived base oil displaying the following inspections:

| | |
|---|---|
| Viscosity at 40° C. | 39.8 cSt |
| Viscosity at 100° C. | 6.35 cSt |
| Viscosity Index (VI) | 108 |
| Pour Point | −14° C. |
| Simulated Distillation, ° F./Wt. % | |
| ST/5 | 687/721 |
| 10/30 | 741/795 |
| 50 | 836 |
| 70/90 | 879/936 |
| 95/EP | 963/1024 |

The various lubricating base oil blends and their relevant properties are shown in Table 1, below.

TABLE 1

| | Blend # | | | |
|---|---|---|---|---|
| | 1 | 2 | 3 | 4 |
| Wt % of Bright Stock | 0.5 | 1.0 | 3.0 | 10.0 |
| Pour Point, ° C. | −13 | −12 | −14 | −23 |
| Vis @ 100° C., cSt. | 6.393 | 6.440 | 6.614 | 7.243 |
| Vis @ 40° C., cSt. | 40.24 | 40.53 | 42.1 | 47.00 |
| VI | 108 | 109 | 110 | 114 |

It will be noted that the pour point was significantly lowered when 10 weight percent of the bright stock was present in the blend (Blend #4). In addition, the VI was raised for those blends containing 1, 3, and 10 weight percent bright stock (Blend #'s 2, 3, and 4, respectively).

Example 3

The bright stock described in Example 1 was blended with a second isomerized petroleum-derived base oil displaying the following inspections:

| | |
|---|---|
| Viscosity at 40° C. | 17.66 cSt |
| Viscosity at 100° C. | 4.017 cSt |
| Viscosity Index (VI) | 128 |
| Pour Point | −20° C. |
| Simulated Distillation, ° F./Wt. % | |
| ST/5 | 683/712 |
| 10/30 | 724/758 |
| 50 | 787 |
| 70/90 | 820/870 |
| 95/EP | 893/953 |

The various lubricating base oil blends and their relevant properties are shown in Table 2, below.

TABLE 2

| | Blend # | | | |
|---|---|---|---|---|
| | 5 | 6 | 7 | 8 |
| Wt % of Bright Stock | 0.5 | 1.0 | 3.0 | 10.0 |
| Pour Point, ° C. | −22 | −22 | −27 | −33 |
| Vis @ 100° C., cSt. | 4.051 | 4.084 | 4.220 | 4.723 |
| Vis @ 40° C., cSt. | 17.97 | 18.19 | 19 | 22.10 |
| VI | 127 | 127 | 129 | 134 |

As in Example 2 above, the bright stock had a significant effect on pour point and VI at the 3.0 weight percent level.

Example 4

The bright stock described in Example 1 was blended with an isomerized Fischer-Tropsch derived base oil displaying the following inspection s:

| | |
|---|---|
| Viscosity at 40° C. | 17.22 cSt |
| Viscosity at 100° C. | 4.104 cSt |
| Viscosity Index (VI) | 145 |
| Pour Point | −20° C. |
| Simulated Distillation, ° F./Wt. % | |
| ST/5 | 643/729 |
| 10/30 | 741/770 |
| 50 | 801 |
| 70/90 | 838/888 |
| 95/EP | 907/949 |

The various lubricating base oil blends and their relevant properties are shown in Table 3, below.

TABLE 3

| | Blend # | | |
|---|---|---|---|
| | 9 | 10 | 11 |
| Wt % of Bright Stock | 3.0 | 6.0 | 9.0 |
| Pour Point, ° C. | −24 | −28 | −28 |
| Vis @ 100° C., cSt. | 4.296 | 4.498 | 4.709 |
| Vis @ 40° C., cSt. | 18.32 | 19.54 | 20.75 |
| VI | 147 | 149 | 153 |

This Example illustrates that the bright stock effectively lowered the pour point and raised the VI of the Fischer-Tropsch derived base oil at the 3.0 weight percent level.

Example 5

The bright stock described in Example 1 was blended with a second isomerized Fischer-Tropsch derived base oil displaying the following inspections:

| | |
|---|---|
| Viscosity at 40° C. | 31.59 cSt |
| Viscosity at 100° C. | 6.295 cSt |
| Viscosity Index (VI) | 154 |
| Pour Point | −14° C. |
| Simulated Distillation, ° F./Wt. % | |
| ST/5 | 803/827 |
| 10/30 | 841/881 |
| 50 | 912 |
| 70/90 | 943/982 |
| 95/EP | 996/1031 |

The various lubricating base oil blends and their relevant properties are shown in Table 4, below.

TABLE 4

| | Blend # | | | |
|---|---|---|---|---|
| | 12 | 13 | 14 | 15 |
| Wt % of Bright Stock | 0.5 | 1.0 | 3.0 | 10.0 |
| Pour Point, ° C. | −14 | −13 | −16 | −23 |
| Vis @ 100° C., cSt. | 6.332 | 6.353 | 6.513 | 7.048 |
| Vis @ 40° C. | 31.86 | 31.93 | 33.16 | 36.98 |
| VI | 154 | 155 | 154 | 155 |

Note the drop in pour point at the 3.0 weight percent and 10.0 weight percent levels.

Example 6

Daqing bright stock was separated into three cuts having the following boiling ranges:

| | | |
|---|---|---|
| Daqing BS Cut # 1 | 950° F.–1050° F. | 28.5 wt. % |
| Daqing BS Cut # 2 | 1050° F.–1150° F. | 36.0 wt. % |
| Daqing BS Cut # 3 | 1150° F. plus | 35.5 wt. % |

Each of the cuts was analyzed by FIMS to determine the paraffin content. The results showed a paraffin content for cut #1 of 20.7 weight percent, cut #2 of 20.6 weight percent, and cut #3 of 47.1 weight percent.

Various lubricating base oil blends were prepared using an isomerized petroleum-derived base oil similar to the one used in Example 3 above. The results are shown in Table 5 below.

TABLE 5

| | ID # | | | | | | | | | | | | | |
|---|---|---|---|---|---|---|---|---|---|---|---|---|---|---|
| | A wt % | B wt % | C wt % | D wt % | E wt % | F wt % | G wt % | H wt % | I wt % | J wt % | K wt % | L wt % | M wt % | N wt % |
| Base Oil | 100.0 | 99.6 | 94.6 | 89.6 | 95.0 | 90.0 | 94.6 | 89.6 | 95.0 | 90.0 | 94.6 | 89.6 | 95.0 | 90.0 |
| Dq Cut #1 | | | 5.0 | 10.0 | 5.0 | 10.0 | | | | | | | | |
| Dq Cut #2 | | | | | | | 5.0 | 10.0 | 5.0 | 10.0 | | | | |

TABLE 5-continued

| | ID # | | | | | | | | | | | | | |
|---|---|---|---|---|---|---|---|---|---|---|---|---|---|---|
| | A wt % | B wt % | C wt % | D wt % | E wt % | F wt % | G wt % | H wt % | I wt % | J wt % | K wt % | L wt % | M wt % | N wt % |
| Dq Cut #3 | | | | | | | | | | | 5.0 | 10.0 | 5.0 | 10.0 |
| Visoplex 1-301* | | 0.40 | 0.40 | 0.40 | | | 0.40 | 0.40 | | | 0.40 | 0.40 | | |
| Total wt. % | 100.0 | 100.0 | 100.0 | 100.0 | 100.0 | 100.0 | 100.0 | 100.0 | 100.0 | 100.0 | 100.0 | 100.0 | 100.0 | 100.0 |
| Test | | | | | | | | | | | | | | |
| Vis. @ 100° C., cSt. | 4.017 | 4.081 | 4.29 | 4.399 | 4.217 | 4.452 | 4.399 | 4.763 | 4.327 | 4.692 | 4.549 | 5.114 | 4.478 | 5.043 |
| VI | 128 | 127 | 130 | 132 | 127 | 130 | 132 | 138 | 129 | 136 | 135 | 145 | 132 | 144 |
| PP ° C.** | −20 | −43 | −42 | −42 | −20 | −20 | −39 | −40 | −25 | −31 | −38 | −43 | −35 | −33 |

*Pour Point Depressant
**Pour Point

Note that while Daqing cut #2 was effective in lowering the pour point and raising the VI of the base oil, Daqing cut #3 was the most effective.

Example 7

Using three cuts of Daqing bright stock as in Example 6 above, various lubricating base oil blends were prepared using an isomerized petroleum-derived base oil similar to the one used in Example 2 above. The results are shown in Table 6 below.

TABLE 6

| | ID # | | | | | | | | | | | | | |
|---|---|---|---|---|---|---|---|---|---|---|---|---|---|---|
| | A1 wt % | B1 wt % | C1 wt % | D1 wt % | E1 wt % | F1 wt % | G1 wt % | H1 wt % | I1 wt % | J1 wt % | K1 wt % | L1 wt % | M1 wt % | N1 wt % |
| Base Oil | 100.0 | 99.6 | 94.6 | 89.6 | 95.0 | 90.0 | 94.6 | 89.6 | 95.0 | 90.0 | 94.6 | 89.6 | 95.0 | 90.0 |
| Dq Cut #1 | | | 5.0 | 10.0 | 5.0 | 10.0 | | | | | | | | |
| Dq Cut #2 | | | | | | | 5.0 | 10.0 | 5.0 | 10.0 | | | | |
| Dq Cut #3 | | | | | | | | | | | 5.0 | 10.0 | 5.0 | 10.0 |
| Visoplex 1-301* | | 0.40 | 0.40 | 0.40 | | | 0.40 | 0.40 | | | 0.40 | 0.40 | | |
| Total wt. % | 100.0 | 100.0 | 100.0 | 100.0 | 100.0 | 100.0 | 100.0 | 100.0 | 100.0 | 100.0 | 100.0 | 100.0 | 100.0 | 100.0 |
| Test | | | | | | | | | | | | | | |
| Vis. @ 100° C., cSt. | 6.457 | 6.555 | 6.784 | 6.997 | 6.669 | 6.895 | 6.959 | 7.387 | 6.856 | 7.278 | 7.232 | 7.939 | 7.122 | 7.835 |
| VI | 104 | 106 | 109 | 111 | 107 | 110 | 110 | 113 | 108 | 111 | 111 | 116 | 110 | 114 |
| PP ° C.** | −12 | −40 | −37 | −40 | −14 | −13 | −39 | −40 | −16 | −18 | −43 | −39 | −24 | −32 |

*Pour Point Depressant
**Pour Point

The results in Table 6 confirm the conclusions in Example 6, above. Daqing bright stock cut #2 was effective in depressing the pour point of the blend and raising the VI. Daqing bright stock cut #3 was the most effective.

Example 8

The pour point depressing ability of the Daqing bright stock of Example 1 was compared to a petroleum-derived solvent dewaxed bright stock (Citgo 150 BS) which had the following inspections:

| | |
|---|---|
| Kinematic viscosity at 100° C. | 30.6 cSt |
| Viscosity index (VI) | 94 |
| Pour point | −13° C. |

The Daqing BS and the Citgo 150 BS were each blended separately with a isomerized 100 Neutral base oil (Chevron 100R). The properties of the various blends is shown in Table 7 below.

TABLE 7

| | ID# | | | | |
|---|---|---|---|---|---|
| | A2 wt % | B2 wt % | C2 wt % | D2 wt % | E2 wt % |
| Base Oil | 100 | 95.0 | 90.0 | 95.0 | 90.0 |
| Citgo 150 BS | | 5.0 | 10.0 | | |
| Daqing BS | | | | 5.0 | 10.0 |
| Total wt. | 100 | 100 | 100 | 100 | 100 |
| Test | | | | | |
| Vis. @ 40° C., cSt | 20.55 | 22.63 | 25.65 | 22.51 | 25.35 |
| Vis. @ 100° C., cSt. | 4.137 | 4.448 | 4.833 | 4.458 | 4.865 |
| VI | 101 | 107 | 110 | 109 | 115 |
| PP ° C.* | −13 | −10 | −11 | −13 | −16 |

**Pour Point

The solvent dewaxed bright stock was not effective in lowering the pour point of the 100 neutral base oil, although the viscosity and the VI both increased (See ID#'s B2 and C2). The isomerized Daqing bright stock significantly lowered the pour point at the 10 weight percent (ID# E2).

Example 9

Daqing bright stock of Example 1 was blended with a solvent dewaxed 100 Neutral base oil (ExxonMobil AC 100). The results are shown in Table 8 below.

TABLE 8

| | ID# | | |
|---|---|---|---|
| | A3 wt % | B3 wt % | C3 wt % |
| Base Oil | 100 | 95.0 | 90.0 |
| Daqing BS | — | 5.0 | 10.0 |
| Total wt. | 100 | 100 | 100 |
| Test | | | |
| Vis. @ 40° C., cSt | 20.24 | 22.95 | 26.14 |
| Vis. @ 100° C., cSt. | 4.046 | 4.4 | 4.801 |
| VI | 95 | 100 | 103 |
| PP ° C.* | −19 | −18 | −19 |

*Pour Point

It should be noted that there was no appreciable change in pour point when the Daqing bright stock was blended with a solvent dewaxed base oil. These results may be compared to the blend identified as ID# E2 in Table 7 where the same Daqing bright stock reduced the pour point of the isomerized base oil.

What is claimed is:

1. A method for improving the lubricating properties of an isomerized distillate base oil having a kinematic viscosity at 100 degrees C. between about 2.5 cSt and about 8 cSt, the method comprising blending with said isomerized distillate base oil a sufficient amount of a pour point depressing base oil blending component to reduce the pour point of the resulting base oil blend at least 3 degrees C. below the pour point of the isomerized distillate base oil wherein the pour point depressing base oil blending component is an isomerized petroleum derived base oil containing material having a boiling range above about 1050 degrees F.

2. The method of claim 1 wherein at least 40 weight percent of the pour point depressing base oil blending component boils above about 1050 degrees F.

3. The method of claim 2 wherein at least 60 weight percent of the pour point depressing base oil blending component boils above about 1050 degrees F.

4. The method of claim 3 wherein at least 80 weight percent of the pour point depressing base oil blending component boils above about 1050 degrees F.

5. The method of claim 2 wherein at least 90 weight percent of the pour point depressing base oil blending component boils above about 1150 degrees F.

6. The method of claim 1 wherein the pour point depressing base oil blending component contains at least 30 percent by weight of paraffins.

7. The method of claim 6 wherein the pour point depressing base oil blending component contains at least 40 percent by weight of paraffins.

8. The method of claim 7 wherein the pour point depressing base oil blending component contains at least 50 percent by weight of paraffins.

9. The method of claim 1 wherein the base oil blend has a kinematic viscosity at 100 degrees C. between about 3 cSt and about 8 cSt.

10. The method of claim 9 wherein the base oil blend has a kinematic viscosity at 100 degrees C. between about 4 cSt and about 7 cSt.

11. The method of claim 1 wherein the base oil blend contains about 15 weight percent or less of the pour point depressing base oil blending component.

12. The method of claim 11 wherein the base oil blend contains about 7 weight percent or less of the pour point depressing base oil blending component.

13. The method of claim 12 wherein the base oil blend contains about 3.5 weight percent or less of the pour point depressing base oil blending component.

14. The method of claim 1 wherein a sufficient amount of the pour point depressing base oil blending component is blended with the isomerized distillate base oil to reduce the pour point of the base oil blend at least 6 degrees C. below the pour point of the distillate base oil.

15. The method of claim 14 wherein a sufficient amount of the pour point depressing base oil blending component is blended with the isomerized distillate base oil to reduce the pour point of the base oil blend at lease 9 degrees C. below the pour point of the distillate base oil.

16. The method of claim 1 wherein the VI of the base oil blend is higher than the VI of the isomerized distillate base oil.

17. The method of claim 16 wherein the VI of the base oil blend is at least 3 numbers higher than the VI of the isomerized distillate base oil.

18. The method of claim 16 wherein the VI of the base oil blend is higher than 110.

19. The method of claim 1 wherein the isomerized distillate base oil is a Group II base oil having a VI of less than 110 and the base oil blend is a Group II plus base oil.

20. The method of claim 1 wherein the isomerized distillate base oil is a Group II base oil and the base oil blend is a Group III base oil.

21. The method of claim 1 wherein the pour point depressing base oil blending component is bright stock.

22. The method of claim 21 wherein the bright stock is derived from Daqing crude.

23. The method of claim 1 including the additional step of blending with the isomerized distillate base oil and the pour point depressing base oil blending component between 0.1 and about 1 weight percent of a pour point additive.

24. A lubricating base oil blend having a kinematic viscosity at 100 degrees C. above about 3 cSt and further containing a high boiling fraction having a boiling range above about 950 degrees C. and a low boiling fraction having a boiling range below about 950 degrees C., wherein when the high boiling fraction is distilled out the low boiling fraction has a higher pour point than the entire lubricating base oil blend.

25. The lubricating base oil blend of claim 24 wherein the high boiling fraction contains about 30 weight percent or more of paraffins.

26. The lubricating base oil blend of claim 25 wherein the high boiling fraction contains about 40 weight percent or more of paraffins.

27. The lubricating base oil blend of claim 26 wherein the high boiling fraction contains about 50 weight percent or more of paraffins.

28. The lubricating base oil blend of claim 24 having a kinematic viscosity at 100 degrees C. between about 3 cSt and about 8 cSt.

29. The lubricating base oil blend of claim 24 wherein the high boiling fraction has a boiling range above about 1050 degrees F.

30. The lubricating base oil blend of claim 29 wherein the high boiling fraction has a boiling range above about 1150 degrees F.

31. The lubricating base oil blend of claim 24 wherein the high boiling fraction comprises bright stock.

32. The lubricating base oil blend of claim 24 wherein the entire lubricating base oil has a pour point which is at least 3 degrees C. below the pour point of the low boiling fraction.

33. The lubricating base oil blend of claim 32 wherein the entire lubricating base oil has a pour point which is at least 6 degrees C. below the pour point of the low boiling fraction.

34. The lubricating base oil of claim 33 wherein the entire lubricating base oil blend has a pour point which is at least 9 degrees C. below the pour point of the low boiling fraction.

35. The lubricating base oil blend of claim 24 wherein the VI of the entire lubricating base oil is higher than the VI of the low boiling fraction.

36. The lubricating base oil blend of claim 35 having a VI of between about 110 and about 120 and the VI of the high boiling fraction is less than 110.

37. The lubricating base oil of claim 35 having a VI above about 120 and the VI of the high boiling fraction is below 120.

38. The lubricating base oil blend of claim 24 having a cloud point of 0 degrees C. or less.

39. A pour point depressing base oil blending component suitable for lowering the pour point of a base oil which comprises an isomerized petroleum derived bottoms product having an average molecular weight of at least 600 and an average degree of branching in the molecules between about 5 and about 8 alkyl-branches per 100 carbon atoms.

40. The pour point depressing base oil blending component of claim 39 having a molecular weight of at least 700.

41. The pour point depressing base oil blending component of claim 40 having a molecular weight of at least 800.

42. The pour point depressing base oil blending component of claim 39 having an average degree of branching in the molecules between about 6 and about 8 alkyl-branches per 100 carbon atoms.

43. The pour point depressing base oil blending component of claim 39 having a pour point falling between about −20 degrees C. and about 20 degrees C.

44. The pour point depressing base oil blending component of claim 43 having a pour point falling between about −10 degrees C. and about 20 degrees C.

45. The pour point depressing base oil blending component of claim 39 wherein at least 80 weight percent boils above about 1050 degrees F.

46. The pour point depressing base oil blending component of claim 45 wherein at least 90 weight percent boils above about 1150 degrees F.

* * * * *